US008951174B2

(12) United States Patent
Huang

(10) Patent No.: US 8,951,174 B2
(45) Date of Patent: Feb. 10, 2015

(54) CORE MUSCLE GROUP TRAINING EQUIPMENT AND ITS METHOD OF USE

(75) Inventor: Mao Ying Huang, Changhua County (TW)

(73) Assignee: Dyaco International Inc., Taipei (TW)

( * ) Notice: Subject to any disclaimer, the term of this patent is extended or adjusted under 35 U.S.C. 154(b) by 624 days.

(21) Appl. No.: 13/207,737

(22) Filed: Aug. 11, 2011

(65) Prior Publication Data

US 2012/0277076 A1 Nov. 1, 2012

(30) Foreign Application Priority Data

Apr. 27, 2011 (TW) ..... 100114723 A

(51) Int. Cl.

| | |
|---|---|
| ***A63B 26/00*** | (2006.01) |
| ***A63B 21/00*** | (2006.01) |
| ***A61H 23/02*** | (2006.01) |
| ***A63B 21/008*** | (2006.01) |
| ***A63B 21/02*** | (2006.01) |
| ***A63B 21/04*** | (2006.01) |
| ***A63B 21/055*** | (2006.01) |
| ***A63B 23/02*** | (2006.01) |

(52) U.S. Cl.

CPC ..... *A63B 21/00196* (2013.01); *A61H 23/0263* (2013.01); *A63B 21/0083* (2013.01); *A63B 21/023* (2013.01); *A63B 21/0421* (2013.01); *A63B 21/055* (2013.01); *A63B 21/1488* (2013.01); *A63B 21/1492* (2013.01); *A63B 23/0211* (2013.01); *A63B 23/0216* (2013.01); *A63B 23/0222* (2013.01); *A63B 21/1465* (2013.01); *A63B 21/1469* (2013.01); *A61H 2201/0149* (2013.01); *A61H 2201/1623* (2013.01); *A61H 2201/1635* (2013.01); *A61H 2201/1642* (2013.01); *A61H 2201/5053* (2013.01); *A61H 2203/0431* (2013.01); *A63B 2208/0233* (2013.01)

USPC ..... 482/142; 482/111

(58) Field of Classification Search

CPC ..... A63B 26/003; A63B 26/00
USPC ..... 482/140, 142, 111; 297/217.1
See application file for complete search history.

(56) References Cited

U.S. PATENT DOCUMENTS

| | | | | | |
|---|---|---|---|---|---|
| 3,444,830 | A | * | 5/1969 | Doetsch | 108/136 |
| 4,815,732 | A | * | 3/1989 | Mahvi | 482/142 |
| 5,044,633 | A | * | 9/1991 | Rice | 482/138 |
| 5,080,353 | A | * | 1/1992 | Tench | 482/130 |
| 5,536,067 | A | * | 7/1996 | Pinto | 297/284.11 |
| 5,599,261 | A | * | 2/1997 | Easley et al. | 482/130 |
| 5,755,650 | A | * | 5/1998 | Urso | 482/138 |
| 5,967,610 | A | * | 10/1999 | Lin | 297/340 |
| 6,379,289 | B1 | * | 4/2002 | Gossie | 482/142 |

(Continued)

*Primary Examiner* — Loan H Thanh
*Assistant Examiner* — Andrew S Lo
(74) *Attorney, Agent, or Firm* — Huffman Law Group, PC

(57) ABSTRACT

A core muscle group training equipment includes a seat, a backrest located on the back side of the seat and a damping mechanism provided at the bottom side of the seat. When sitting on the seat and resting the back on the backrest, the user can selectively bend the upper body forwards and backwards to contract the proximal muscles, or keep the upper body immovable and move the lower body up and down to contract distal muscles. By means of biasing of the seat and the damping effect provided by the damping mechanism during operation, the muscle strength of the abdominal muscles is trained. When releasing the pressure, the damping mechanism returns the machine parts smoothly, preventing accidental injury.

29 Claims, 9 Drawing Sheets

(56) References Cited

U.S. PATENT DOCUMENTS

| | | | | |
|---|---|---|---|---|
| 6,475,123 | B1 * | 11/2002 | Evans | 482/97 |
| 6,752,459 | B2 * | 6/2004 | Deisig | 297/316 |
| 7,090,303 | B2 * | 8/2006 | Kropa | 297/466 |
| 7,350,865 | B2 * | 4/2008 | Pearse | 297/312 |
| 7,549,705 | B2 * | 6/2009 | Man et al. | 297/423.21 |
| 7,608,030 | B2 * | 10/2009 | Splane | 482/142 |
| 2004/0152572 | A1 * | 8/2004 | Reitz et al. | 482/140 |
| 2005/0168030 | A1 * | 8/2005 | Bykov et al. | 297/312 |
| 2005/0272581 | A1 * | 12/2005 | Stearns | 482/140 |
| 2009/0045659 | A1 * | 2/2009 | List et al. | 297/216.15 |
| 2009/0108648 | A1 * | 4/2009 | Biggs et al. | 297/217.1 |
| 2010/0009824 | A1 * | 1/2010 | Splane | 482/130 |
| 2010/0190623 | A1 * | 7/2010 | Guissin et al. | 482/142 |
| 2010/0201167 | A1 * | 8/2010 | Wieclawski | 297/216.13 |
| 2010/0289312 | A1 * | 11/2010 | Burr et al. | 297/313 |
| 2012/0181840 | A1 * | 7/2012 | Leone et al. | 297/452.3 |

* cited by examiner

CORE MUSCLE GROUP TRAINING EQUIPMENT AND ITS METHOD OF USE

BACKGROUND OF THE INVENTION

1. Field of the Invention

The present invention relates to body exercising apparatus and more particularly, to a core muscle group training equipment that provides equal speed muscular strength training and vibration stimulation.

2. Description of the Related Art

The so-called core muscle group are the body's stabilizer muscles between the transverse diaphragm and the pelvis bottom around the waist, abdomen and trunk, including transverse abdominis, lumber multifidi, internal obliques, external oblique, rectus abdominis, quadrates lumborum, erector spinae, respiratory diaphragm and pevc floor. The core muscle group stabilizes the body trunk, provides sufficient support to the vertebra and distributes the load of the vertebra, facilitating quick movement of the limbs. Neglecting core muscle group training tends to lead to full-body deficiency in motion ability.

In abdominal muscle training, sit-up is the mostly accepted exercise mode for the advantages of simple action and free site applicability. However, performing sit-up gives a great pressure to the vertebra, thereby tending to cause a vertebral injury. Further, frequently turning the head from a position at a lower elevation relative to the body trunk to a position much higher than the elevation of the body trunk during a sit-up exercise, the exerciser may feel dizzy and experience nausea. More particularly, a hypertension patient may feel uncomfortable when doing sit-ups. Therefore, doing sit-ups is not the best way to train abdominal muscles.

SUMMARY OF THE INVENTION

The present invention has been accomplished under the circumstances in view. It is the main object of the present invention to provide a core muscle group training equipment, which is practical for training the abdominal muscles and enables the user to keep the head above the elevation of the body trunk during exercise, avoiding discomfort.

To achieve this and other objects of the present invention, a core muscle group training equipment comprises a seat spaced above the floor at a predetermined elevation, a backrest arranged at the rear side of the seat, and a damping mechanism pivotally coupled to the bottom side of the seat.

When sitting on the seat and resting the back on the backrest, the user can lift the lower body toward the upper body. By means of biasing of the seat and the damping effect provided by the damping mechanism during operation, the muscle strength of the abdominal muscles is trained.

Preferably, the core muscle group training equipment further comprises a machine base positioned on the floor and pivotally coupled with the seat and the damping mechanism. Further, the machine base has mounted therein a vibration device adapted for vibrating the seat.

Preferably, the core muscle group training equipment further comprises two armrests respectively arranged at the left and right sides of the backrest. Each armrest comprises an armrest bar movable forwards and backwards, and a grip located on the front side of the armrest bar.

To achieve this and other objects of the present invention, a core muscle group training equipment in accordance with an alternate form of the present invention comprises a seat spaced above the floor at a predetermined elevation, a backrest arranged at the rear side of the seat and two armrests.

Each armrest comprises an armrest frame fixedly connected to one of the opposite left and right sides of said backrest body member, an armrest bar inserted into the armrest frame and movable forward and backward relative to the armrest frame and a grip arranged at the front end of the armrest bar. When sitting on the seat, the user can rest the back on the backrest and the hands on the armrest bars of the armrests, and then bend the upper body forwards and backwards and simultaneously move the armrest bars of the armrest forwards and backwards, thereby training the muscle strength of the abdominal muscles.

Preferably, each armrest further comprises a damper connected between the respective armrest frame and the rear end of the respective armrest bar. Preferably, the armrest bar of each armrest comprises a plurality of plugholes longitudinally arranged in a line near the front end thereof; the grip of each armrest is selectively plugged into one of the plugholes of the associating armrest bar.

To achieve this and other objects of the present invention, a core muscle group training equipment in accordance with another alternate form of the present invention comprises a seat spaced above the floor at a predetermined elevation, a support bar vertically arranged at the rear side of the seat, a backrest connected to the top end of the support bar, and a damper connected between the backrest and the top end of the support art. When sitting on the seat and resting the back on the backrest, the user can lift the legs of the lower body toward the upper body to train the muscle strength of the abdominal muscles, and at the same time, the damper provides a damping effect to buffer the backrest.

Preferably, the core muscle group training equipment further comprises a machine base positioned on the floor and pivotally coupled with the damper. The machine base has a vibration device mounted therein and adapted to vibrate the seat.

Preferably, a damping mechanism is provided at the bottom side of the seat to provide a damping effect to the seat.

Other advantages and features of the present invention will be fully understood by reference to the following specification in conjunction with the accompanying drawings, in which like reference signs denote like components of structure.

DETAILED DESCRIPTION OF THE INVENTION

Figure 1:
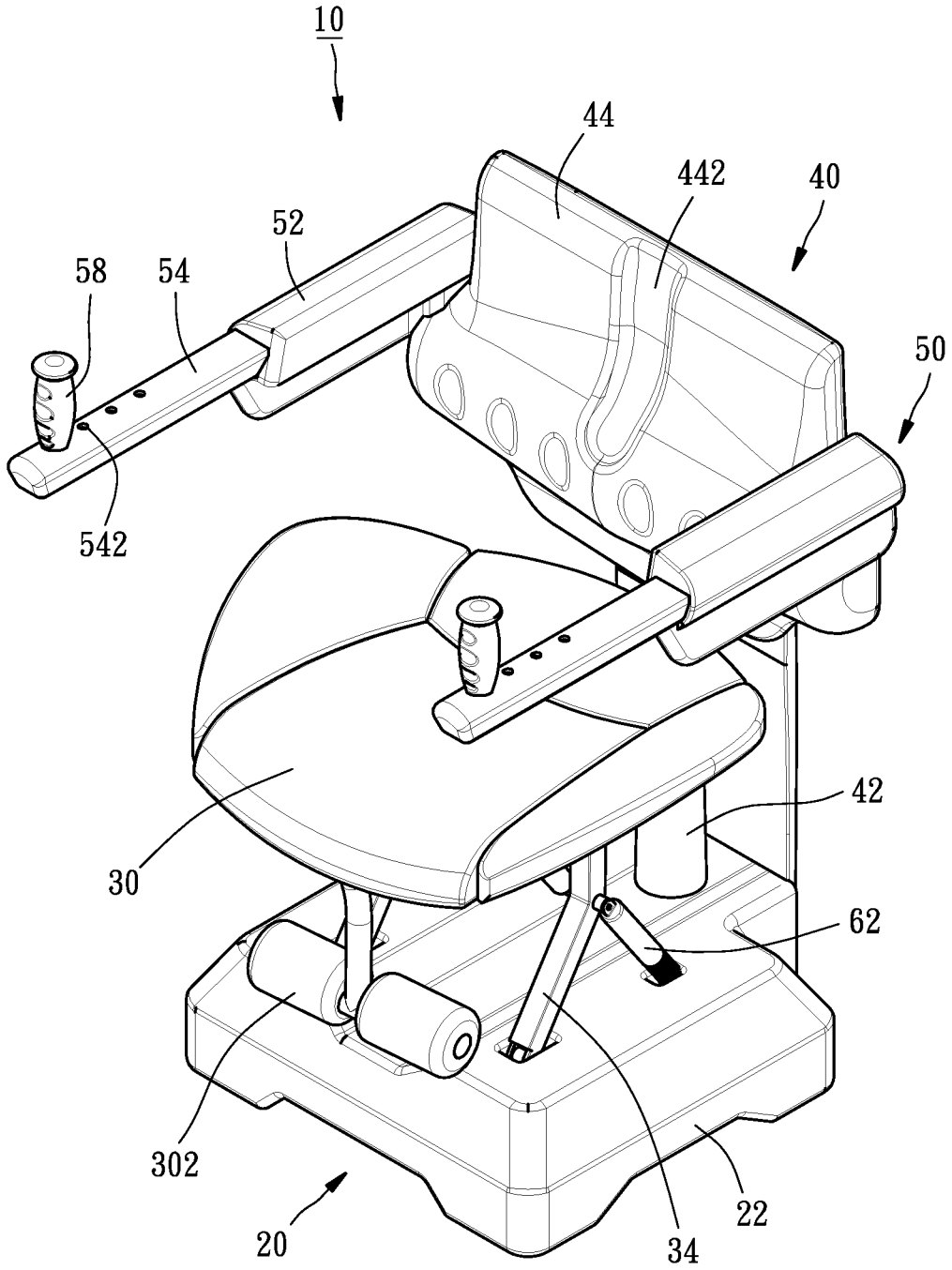
FIG. 1 is an elevational view of a core muscle group training equipment in accordance with the present invention.
Figure 2:
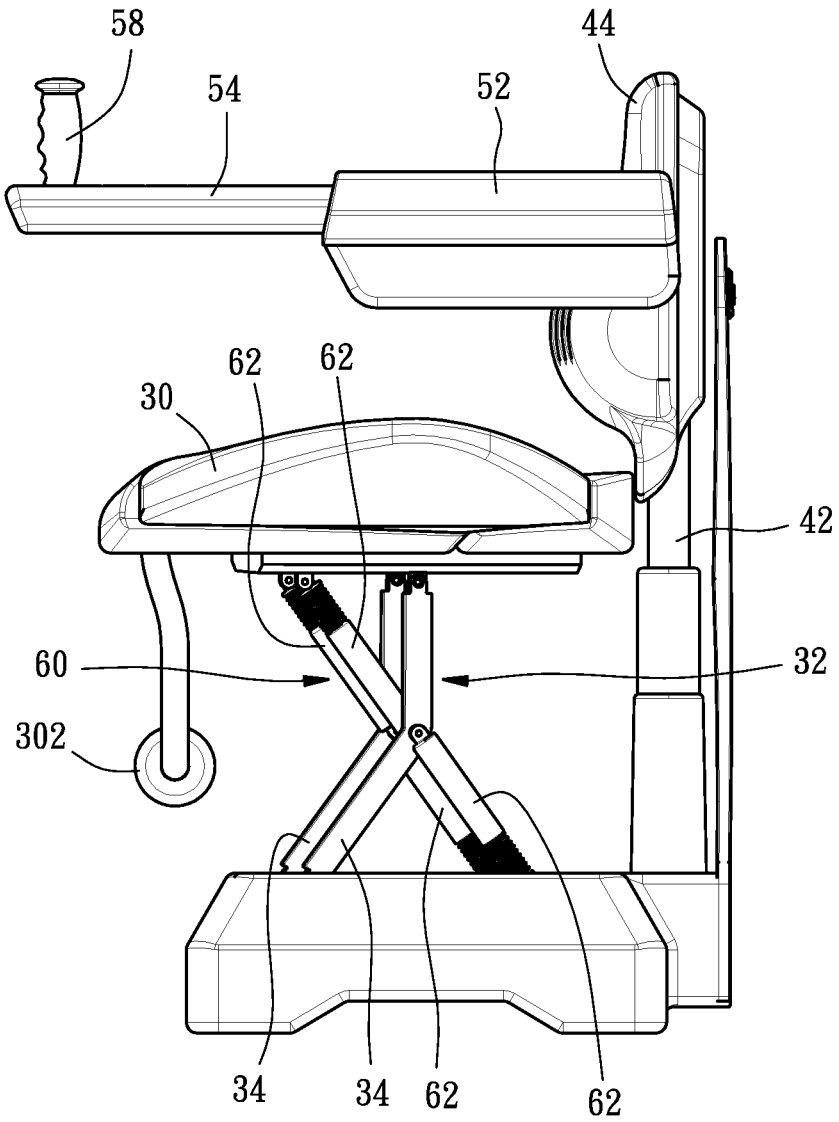
FIG. 2 is a side view of the core muscle group training equipment in accordance with the present invention.

Referring to FIGS. 1 and 2, a core muscle group training equipment 10 in accordance with the present invention is shown comprising a machine base 20, a seat 30, a backrest 40, two armrests 50 and a damping mechanism 60.

Figure 3:
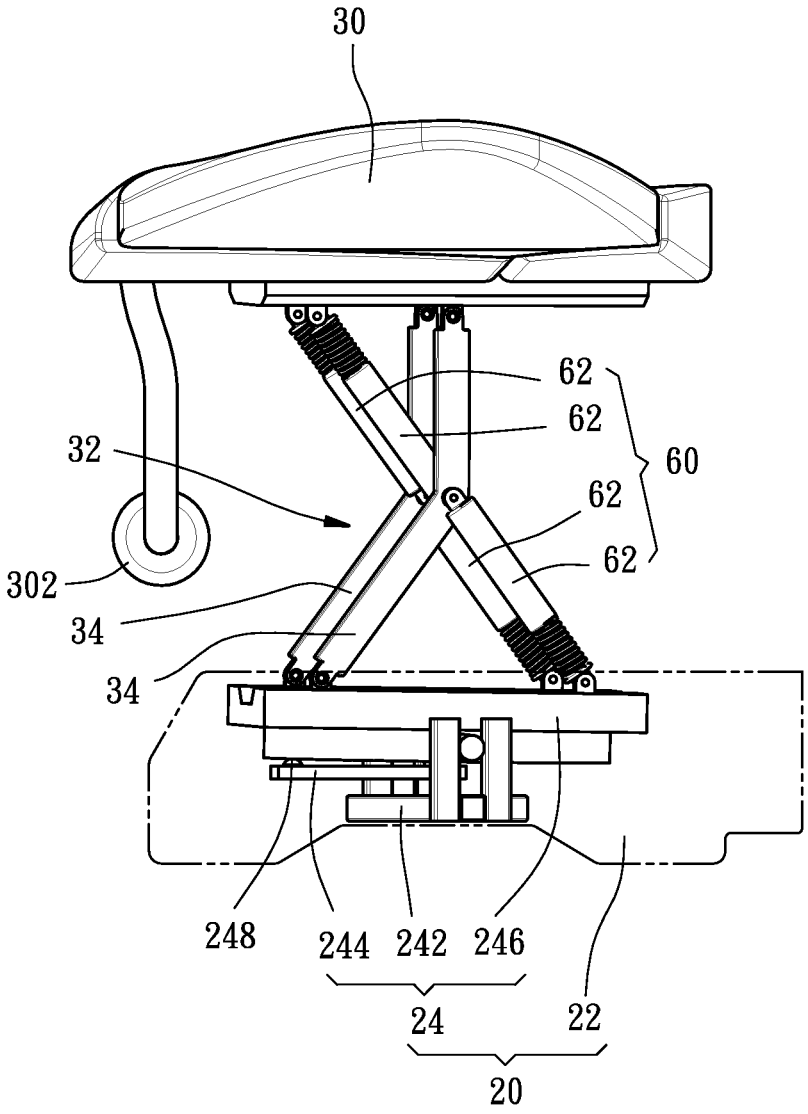
FIG. 3 is a sectional side view of a part of the present invention, illustrating the internal structure of the machine base of the core muscle group training equipment.

Referring to FIG. 3, the machine base 20 comprises a housing 22, and a vibration device 24 mounted inside the housing 22. The vibration device 24 comprises a power drive 242, a wheel 244 coupled to and rotatable by the power drive 242 and having a raised portion 248 eccentrically located on the top wall thereof, and a bearing plate 246 supported on the raised portion 248 of the wheel 244 and vibratable by the raised portion 248 during rotation of the wheel 244.

Referring to FIG. 3 again, the seat 30 is disposed at the top side of the machine base 20 and coupled to the machine base 20 by a linkage 32, having a transverse stop member 302 suspending in the front bottom side thereof. The linkage 32 comprises a pair of links 34 and a transverse rod (not shown). The links 32 have the opposing top and bottom ends thereof respectively pivotally coupled to the seat 30 and the bearing plate 246 of the vibration device 24. The transverse rod is connected between the links 34. Thus, the vibration force produced by the bearing plate 246 of the vibration device 24 can be transferred by the linkage 32 to the seat 30 to cause a synchronous vibration.

Figure 4:
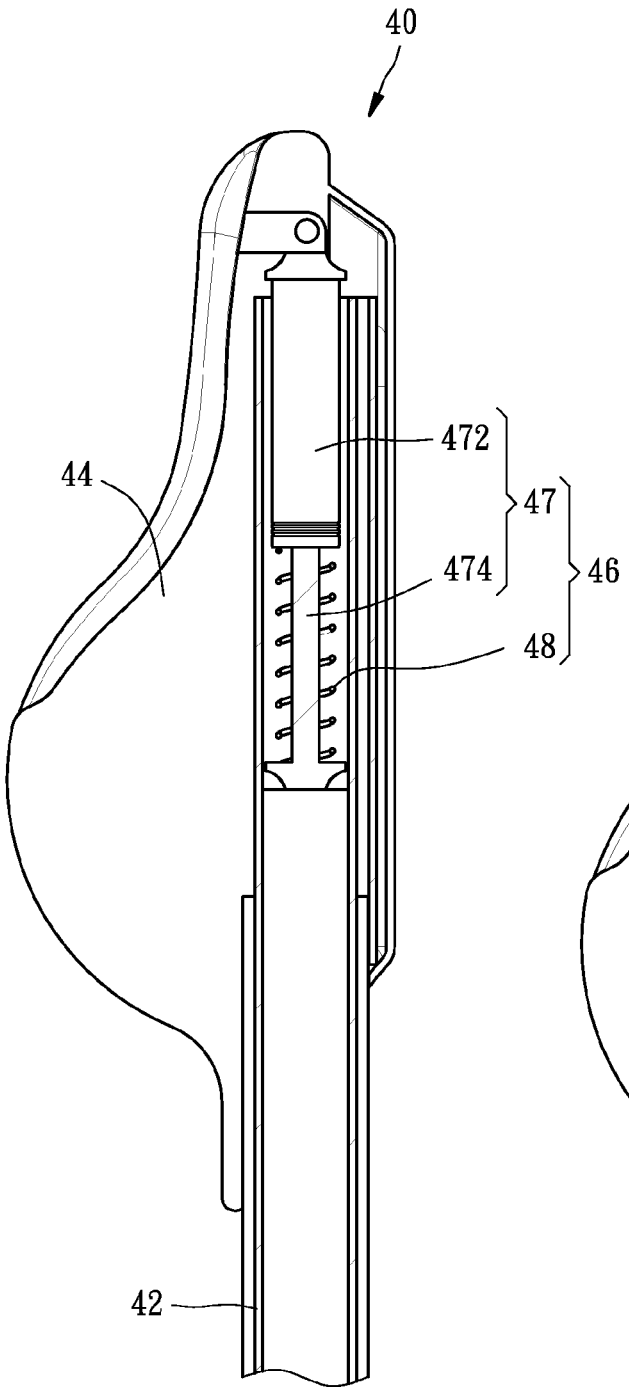
FIG. 4 is a sectional side view of the backrest of the core muscle group training equipment in accordance with the present invention.
Figure 5:
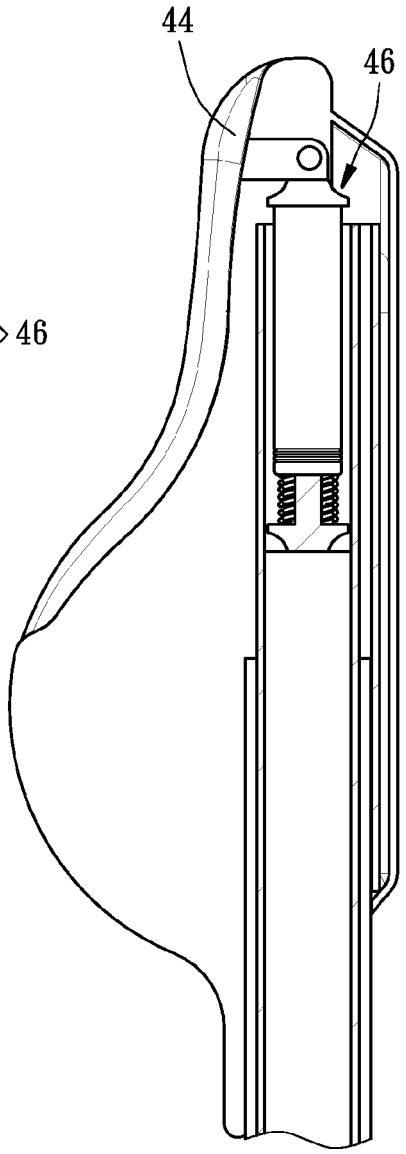
FIG. 5 corresponds to FIG. 4, illustrating the backrest body member lowered with the respective damper relative to the support bar.

Referring to FIGS. 4 and 5 and FIGS. 1 and 2 again, the backrest 40 comprises a support bar 42, a backrest body member 44 and a damper 46. The support bar 42 has its bottom end connected to the housing 22 of the machine base 20. The backrest body member 44 is coupled to the top end of the support bar 42 and movable up and down relative to the support bar 42, having an accommodation groove 442 located on the middle of the front wall thereof and adapted for accommodating the lumbar spine area of the user's back. The damper 46 consists of a hydraulic cylinder 47 and a spring member 48. The hydraulic cylinder 47 comprises a cylinder body 472 affixed to the backrest body member 44, and a piston rod 474 movable in and out of the cylinder body 472 and coupled with the free end thereof to the top end of the support bar 42. Thus, the hydraulic cylinder 47 imparts a damping resistance to the backrest body member 44 when the backrest body member 44 is being moved downwards relative to the support bar 42 by an external force. As shown in FIGS. 4 and 5, the spring member 48 is sleeved onto the piston rod 474 of the hydraulic cylinder 47 and stopped with its two distal ends against the cylinder body 472 of the hydraulic cylinder 47 and the free end of the piston rod 474 respectively for imparting a return force to the backrest body member 44.

Figure 6:
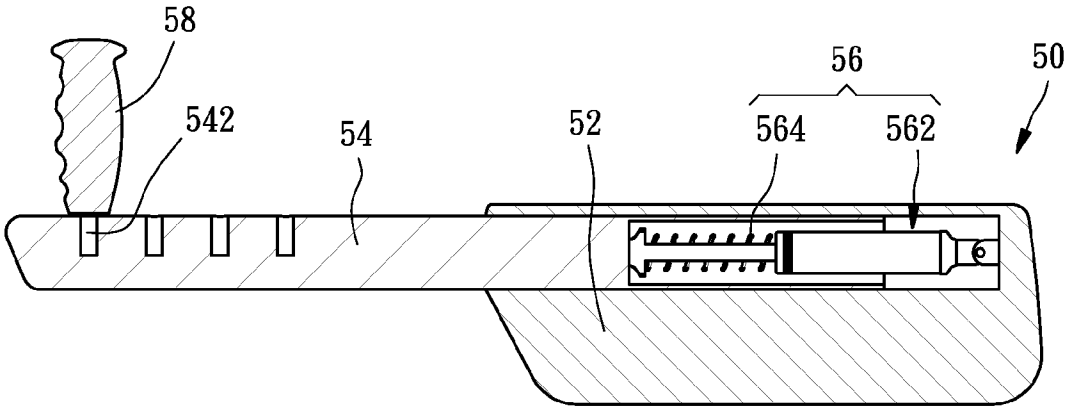
FIG. 6 is a sectional side view of one armrest of the core muscle group training equipment in accordance with the present invention.
Figure 7:
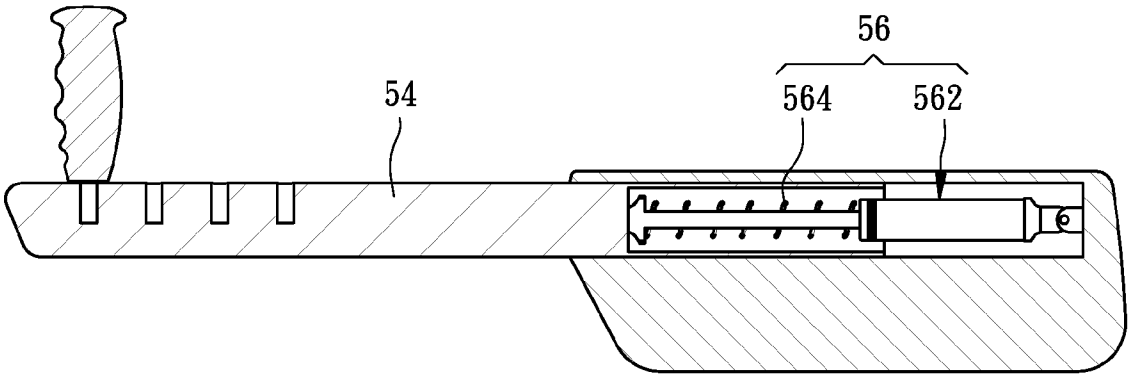
FIG. 7 corresponds to FIG. 6, illustrating the armrest bar moved forwards relative to the armrest frame.

Referring to FIG. 6 and FIGS. 1 and 2 again, each armrest 50 comprises an armrest frame 52, an armrest bar 54, a damper 56 and a grip 58. The armrest frame 52 is fixedly connected to one of the opposite left and right sides of the backrest body member 44 and extending forwardly relative to the seat 30. The armrest bar 54 is inserted with its rear end into the armrest frame 52 and movable forward and backward relative to the armrest frame 52, having a plurality of plugholes 542 longitudinally arranged in a line near the front end thereof. The structure of the damper 56 is same as the damper 46 of the backrest 40, and therefore no further structural description is necessary. The damper 56 is connected between the armrest frame 52 and the rear end of the armrest bar 54 so that the armrest bar 54 can be buffered by the damping resistance of the hydraulic cylinder 562 and the spring force of the spring member 564. The grip 58 is selectively insertable with its bottom end into one of the plughole 542 for holding by different user having different body sizes.

Referring to FIG. 3, the damping mechanism 60 comprises two pairs of dampers 62. The dampers 62 have the same structure as the damper 46 of the backrest 40, and therefore no further structural description is necessary. One pair of dampers 56 are pivotally connected between the seat 30 and the transverse rod of the linkage 32. The other pair of dampers 56 is pivotally connected between the links 34 of the linkage 32 and the bearing plate 246 of the vibration device 24. Thus, the dampers 56 provide a damping effect to the seat 30 during biasing of the seat 30.

After understanding the structural details of the core muscle group training equipment 10, the method of use and characteristics of the core muscle group training equipment 10 are outlined hereinafter.

Figure 8:
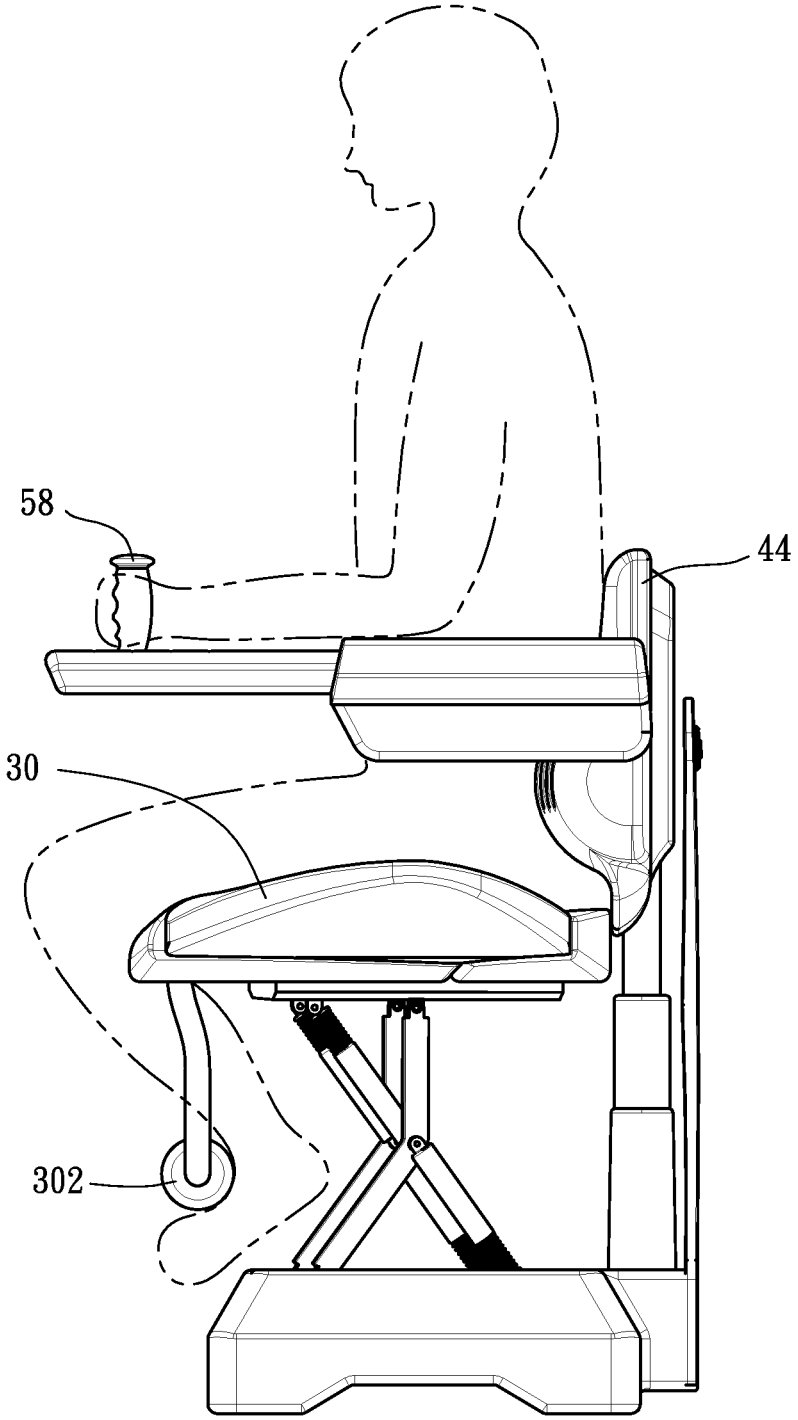
FIG. 8 is a schematic applied view of the core muscle group training equipment in accordance with the present invention (I).
Figure 9:
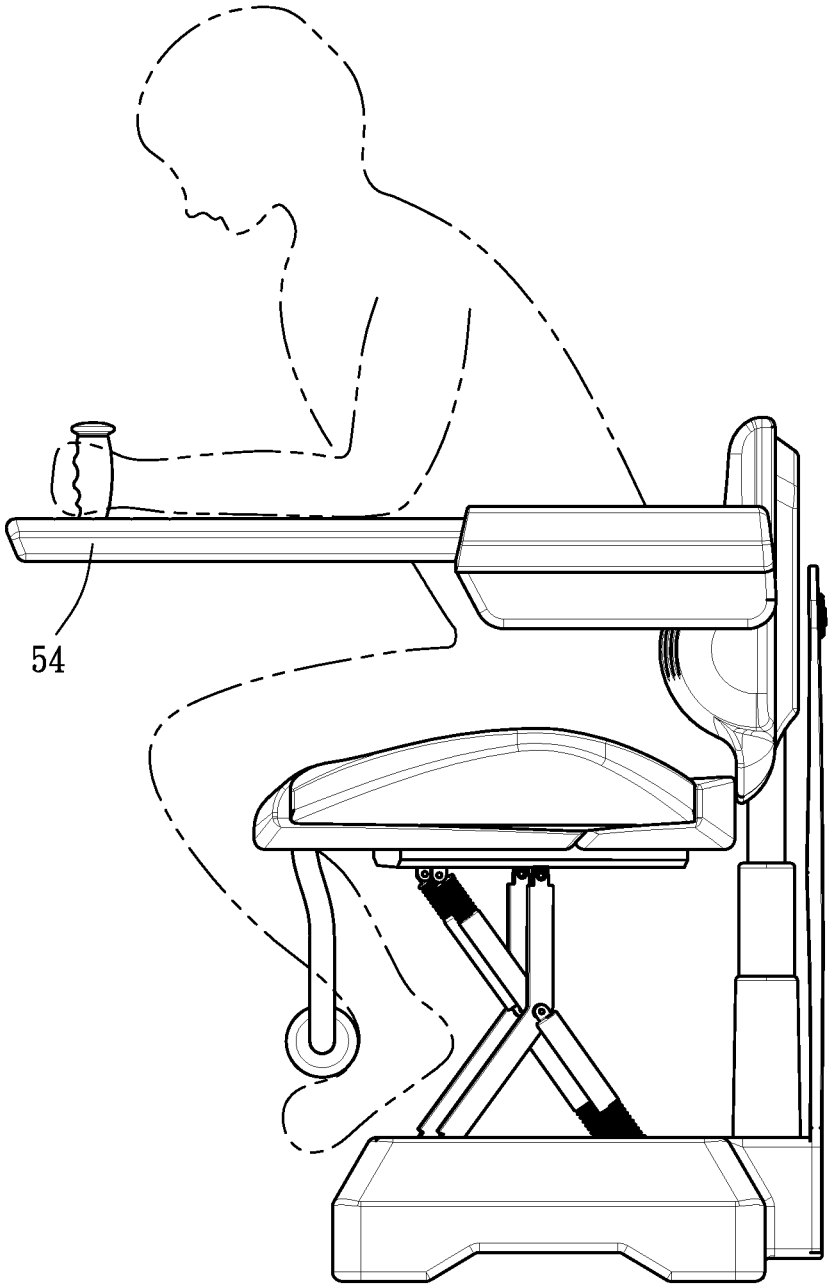
FIG. 9 is a schematic applied view of the core muscle group training equipment in accordance with the present invention (II).

Step a): Sit with the hips on the seat 30 and lie the back on the backrest body member 44 to let the lumbar spine area of the back be rested in the accommodation groove 442 of the backrest body member 44 and to keep the upper body erect, and then hold the position adjusted grips 58 with the two hands and stop the insteps of the legs against the transverse stop member 302 of the seat 30, as shown in FIG. 8.

Step b): Move one of the upper body and the lower body toward the other of the upper body and the lower body to contract the abdominal muscles, thereby training the muscle strength of the abdominal muscles.

Figure 10:
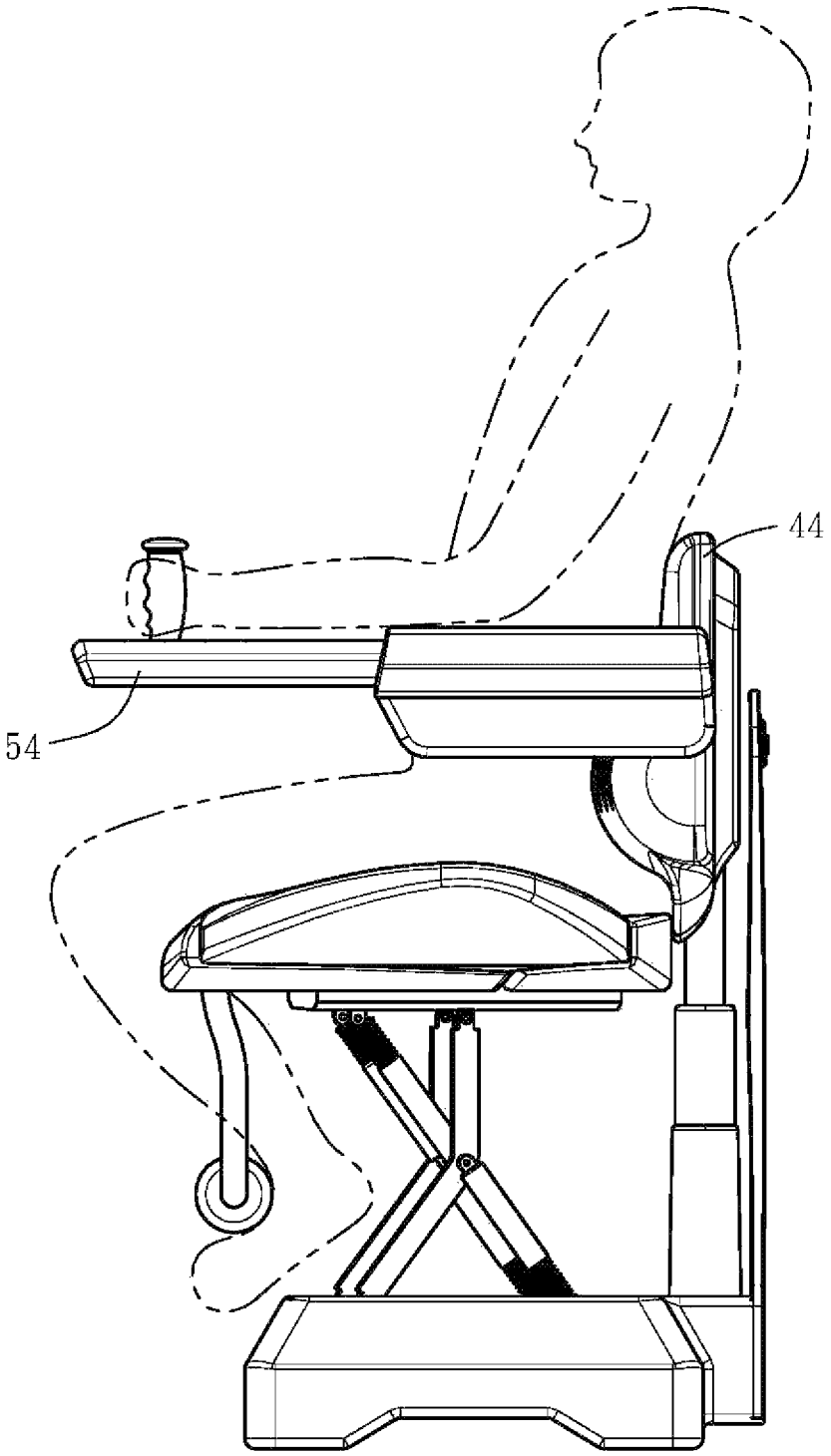
FIG. 10 is a schematic applied view of the core muscle group training equipment in accordance with the present invention (III).

When performing Step b), the user can keep the lower body immobile and bend the upper body alternatively forwards and backwards. At this time, the user can move the armrest bars 54, stabilizing the forward bending action and keeping the lumbar spine straight, as shown in FIG. 8. Thereafter, the damper 56 of each armrest 50 provides a buffer effect when the user is bending the upper body backwards, and one exercising cycle is completed when the user rests the back on the backrest body member 44 and keeps the upper body erect, as shown in FIG. 10. Thus, a user with an endomorph body type can effectively train the muscle strength of the upper abdominal muscles by repeating this forward and backward bending action.

Figure 11:
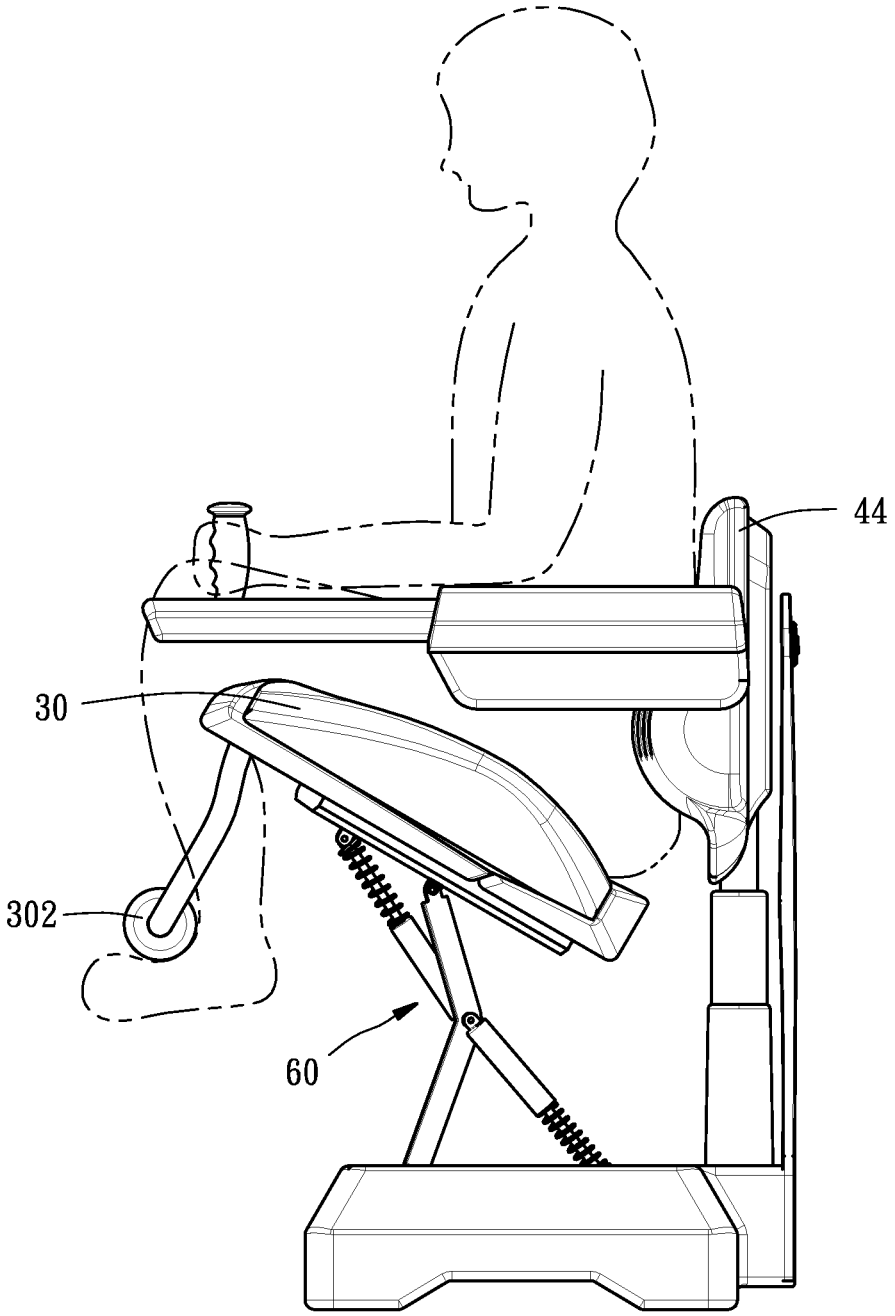
FIG. 11 is a schematic applied view of the core muscle group training equipment in accordance with the present invention (IV).

On the other hand, a user can keep the upper body immobile and move the lower body alternatively up and down. When the user lifts the lower body, the seat 30 will be biased subject to the downward pressure from the user's hips and the pressure from the insteps of the users legs that are stopped against the transverse stop member 302 of the seat 30, and the damping mechanism 60 will be stretched during biasing of the seat 30, as shown in FIG. 11. At the same time, the backrest body member 44 will be forced by the pressure from the user's back to compress the damper 46 of the backrest 40, as shown in FIG. 5. When the user is lowering the legs, the seat 30 will be returned to its former position by the return force of the damping mechanism 60, and the backrest body member 44 will be moved gradually upwardly to its former position by the return force of the damper 46 of the backrest 40, as shown in FIG. 4 and FIG. 8. Thus, repeating this action effectively trains the muscle strength of the lower abdominal muscles.

When wishing to increase the training intensity, the user can exercise the aforesaid two actions to train the upper and lower abdominal muscles. During the aforesaid two exercise actions, the vibration force produced by the bearing plate 246 of the vibration device 24 is transferred by the linkage 32 to the seat 30 to activate the user's abdominal muscles. Further, subject to the damping effects of the dampers 46, vibration stimulation can simply be transferred to the user's abdomen and will not be transferred to the user's head, avoiding user discomfort.

In conclusion, the core muscle group training equipment of the present invention enables the user to train the muscle strength of the abdominal muscles in a sitting position and to keep the head above the elevation of the body trunk, and therefore a person suffering hypertension will not feel uncomfortable when operating the core muscle group training equipment to train the core muscles, or a person suffering hypotension will not feel faint easily when using the core muscle group training equipment. Further, the damping effects of the dampers used in the core muscle group training equipment provide sufficient buffer, preventing lumbar spine or muscle injury due to a quick return action and assuring a high level of protection. Further, the damping force of every damper is adjustable subject to the muscle strength of every individual user, and therefore the core muscle group training equipment fits different users.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A core muscle group training equipment, comprising:
a seat spaced above a floor at a predetermined elevation;
a backrest arranged at a rear side of said seat; and
a damping mechanism pivotally coupled to a bottom side of said seat;
a machine base positioned on the floor to pivotally support said seat and said damping mechanism;
a linkage coupled between said seat and said machine base;
wherein said damping mechanism comprises at least one first damper pivotally coupled between said seat and said linkage and one second damper pivotally coupled between said linkage and said machine base, and said machine base comprises a housing positioned on the floor and a vibration device mounted inside said housing and pivotally connected with said linkage and said damping mechanism and adapted to provide a vibration force to said seat.

2. The core muscle group training equipment as claimed in claim 1, wherein said vibration device comprises a power drive, a wheel coupled to and rotatable by said power drive, said wheel comprising a raised portion eccentrically located on a top wall thereof, and a bearing plate supported on said raised portion of said wheel and vibratable by said raised portion during rotation of said wheel.

3. The core muscle group training equipment as claimed in claim 1, wherein said backrest comprises a backrest body member and a support bar extended from said backrest body member and connected to said machine base.

4. The core muscle group training equipment as claimed in claim 3, wherein said backrest further comprises a damper connected between said backrest body member and a top end of said support bar.

5. The core muscle group training equipment as claimed in claim 1, further comprising two armrests respectively arranged at opposing left and right sides of said backrest.

6. The core muscle group training equipment as claimed in claim 5, wherein each said armrest comprises an armrest frame fixedly connected to one of the opposite left and right sides of said backrest body member, an armrest bar inserted into said armrest frame and movable forward and backward relative to said armrest frame and a grip arranged at a front end of said armrest bar.

7. The core muscle group training equipment as claimed in claim 6, wherein each said armrest further comprises a damper connected between said armrest frame and a rear end of said armrest bar.

8. The core muscle group training equipment as claimed in claim 6, wherein the armrest bar of each said armrest comprises a plurality of plugholes longitudinally arranged in a line near the front end thereof; the grip of each said armrest is selectively plugged into one of the plugholes of the associating armrest bar.

9. The core muscle group training equipment as claimed in claim 1, wherein said backrest comprises an accommodation groove located on a middle part of a front wall of a backrest body member thereof and adapted for accommodating the lumbar spine area of the back of the user.

10. The core muscle group training equipment as claimed in claim 1, wherein said seat further comprises a transverse stop member suspending in a front bottom side thereof for stopping the insteps of the legs of the user.

11. A core muscle group training equipment, comprising:
a seat spaced above a floor at a predetermined elevation;
a backrest arranged at a rear side of said seat; and
two armrests respectively arranged at opposing left and right sides of said backrest, each said armrest comprising an armrest frame fixedly connected to one of the opposite left and right sides of said backrest, an armrest bar inserted into said armrest frame and movable forward and backward relative to said armrest frame and a grip arranged at a front end of said armrest bar;
wherein each said armrest further comprises a damper connected between said armrest frame and a rear end of said armrest bar, the damper comprises a hydraulic cylinder and a spring member connected with the hydraulic cylinder, and the armrest bar can be buffered by the damping resistance of the hydraulic cylinder and the spring force of the spring member; and wherein the armrest bar of each said armrest comprises a plurality of plugholes longitudinally arranged in a line near the front end thereof; the grip of each said armrest is selectively plugged into one of the plugholes of the associating armrest bar.

12. The core muscle group training equipment as claimed in claim 11, further comprising a machine base positioned on the floor and a linkage coupled between said seat and said machine base.

13. The core muscle group training equipment as claimed in claim 12, wherein said linkage has two distal ends thereof respectively pivotally connected said machine base and said seat.

14. The core muscle group training equipment as claimed in claim 13, further comprising a damping mechanism pivotally coupled with said seat, said linkage and said machine base.

15. The core muscle group training equipment as claimed in claim 14, wherein said machine base comprises a housing positioned on the floor and a vibration device mounted inside said housing and pivotally connected with said linkage and said damping mechanism and adapted to provide a vibration force to said seat.

16. The core muscle group training equipment as claimed in claim 14, wherein said damping mechanism comprises at least one first damper pivotally coupled between said seat and said linkage and one second damper pivotally coupled between said linkage and said machine base.

17. The core muscle group training equipment as claimed in claim 12, wherein said backrest comprises a backrest body member and a support bar extended from said backrest body member and connected to said machine base.

18. The core muscle group training equipment as claimed in claim 17, wherein said backrest further comprises a damper connected between said backrest body member and a top end of said support bar.

19. The core muscle group training equipment as claimed in claim 11, wherein said backrest comprises an accommodation groove located on a middle part of a front wall of a backrest body member thereof and adapted for accommodating the lumbar spine area of the back of the user.

20. The core muscle group training equipment as claimed in claim 11, wherein said seat further comprises a transverse stop member suspending in a front bottom side thereof for stopping the insteps of the legs of the user.

21. A core muscle group training equipment, comprising:

a seat spaced above a floor at a predetermined elevation;

a support bar vertically arranged at a back side of said seat;

a backrest connected to a top end of said support bar;

a damper connected between said backrest and the top end of said support bar;

a damping mechanism pivotally coupled to a bottom side of said seat;

a machine base positioned on the floor and pivotally coupled with said seat and said damping mechanism; and a linkage coupled between said seat and said machine base;

wherein said machine base comprises a housing positioned on the floor and a vibration device mounted inside said housing and pivotally connected with said linkage and said damping mechanism and adapted to provide a vibration force to said seat.

22. The core muscle group training equipment as claimed in claim 21, wherein said damping mechanism comprises at least one first damper pivotally coupled between said seat and said linkage and one second damper pivotally coupled between said linkage and said machine base.

23. The core muscle group training equipment as claimed in claim 21, wherein said vibration device comprises a power drive, a wheel coupled to and rotatable by said power drive, said wheel comprising a raised portion eccentrically located on a top wall thereof, and a bearing plate supported on said raised portion of said wheel and vibratable by said raised portion during rotation of said wheel.

24. The core muscle group training equipment as claimed in claim 21, wherein said backrest comprises an accommodation groove located on a middle part of a front wall of a backrest body member thereof and adapted for accommodating the lumbar spine area of the back of the user.

25. The core muscle group training equipment as claimed in claim 21, wherein said seat comprises a transverse stop member suspending in a front bottom side thereof for stopping the insteps of the legs of the user.

26. The core muscle group training equipment as claimed in claim 21, further comprising two armrests respectively arranged at opposing left and right sides of said backrest.

27. The core muscle group training equipment as claimed in claim 26, wherein each said armrest comprising an armrest frame fixedly connected to one of the opposite left and right sides of said backrest, an armrest bar inserted into said armrest frame and movable forward and backward relative to said armrest frame, and a grip arranged at a front end of said armrest bar.

28. The core muscle group training equipment as claimed in claim 27, wherein each said armrest further comprises a damper connected between said armrest frame and a rear end of said armrest bar.

29. The core muscle group training equipment as claimed in claim 27, wherein the armrest bar of each said armrest comprises a plurality of plugholes longitudinally arranged in a line near the front end thereof; the grip of each said armrest is selectively plugged into one of the plugholes of the associating armrest bar.

* * * * *